US006377164B1

(12) United States Patent
Fulmer

(10) Patent No.: US 6,377,164 B1
(45) Date of Patent: Apr. 23, 2002

(54) HIGH POWERED TRI-MODE LIGHT SHOW

(76) Inventor: Chester C. Fulmer, 1803 SW. 31 St., Allentown, PA (US) 18103

( * ) Notice: Subject to any disclaimer, the term of this patent is extended or adjusted under 35 U.S.C. 154(b) by 0 days.

(21) Appl. No.: 09/523,482

(22) Filed: Mar. 10, 2000

Related U.S. Application Data

(60) Provisional application No. 60/123,650, filed on Mar. 10, 1999.

(51) Int. Cl.[7] ..... G08B 21/00

(52) U.S. Cl. ..... 340/331; 340/309.15; 340/309.4; 315/200 A; 362/212; 362/213

(58) Field of Search ..... 340/331, 309.15, 340/309.2, 309.3, 309.4; 315/200 A, 209 R; 463/7; 273/460; 362/212, 213

(56) References Cited

U.S. PATENT DOCUMENTS 4,520,278 A 5/1985 De Roo
5,060,941 A * 10/1991 Barra ..... 273/85 R
5,118,319 A * 6/1992 Smith et al. ..... 446/219
5,157,382 A * 10/1992 Stopa ..... 340/475
5,229,653 A 7/1993 Lamarche
5,243,504 A * 9/1993 Sejzer ..... 362/154
5,335,598 A 8/1994 Lewis et al.
5,430,401 A 7/1995 Shtulman
5,741,181 A * 4/1998 Nakagawa et al. ..... 463/6
5,877,614 A 3/1999 Huber
6,053,622 A * 4/2000 Horowitz et al. ..... 362/276

* cited by examiner

*Primary Examiner*—Edward Lefkowitz
*Assistant Examiner*—Davetta W. Goins
(74) *Attorney, Agent, or Firm*—Gene Scott-Patent Law & Venture Group

(57) ABSTRACT

An electrical circuit apparatus produces a light show utilizing simple mechanical relays. The apparatus includes electrical circuit elements that include electrical relaying means, lighting means, electrical timing means, DC power supplying means, and means for receiving an AC utility current. Electrical impulses are enabled as light impulses to produce a light show designed to produce an automatically cycling arrangement of at least three different lights.

1 Claim, 1 Drawing Sheet

HIGH POWERED TRI-MODE LIGHT SHOW

The present application claims the priority date of a previously filed provisional patent application having serial No. 60/123,650 and an assigned filing date of Mar. 10, 1999 and which contains subject matter substantially the same as that described and claimed in the present application.

BACKGROUND OF THE INVENTION

1. Field of the Invention

This invention relates generally to electronic light show devices and more particularly to a light show device utilizing simple mechanical relays.

2. Description of Related Art

The following art defines the present state of this field:

Huber et. al. U.S. Pat. No. 5,877,614 describes an electronic switch-mode power supply having a rectifier circuit at a line ac voltage and which comprises a pair of outputs at high level or at ground reference potential, and having an output stage that supplies a smoothed dc voltage. The rectifier circuit is connected to the output stage via an electronic switch, and, triggered by a switch control signal supplied to the electronic switch, can thus be optionally coupled to the outputs of the rectifier circuit. The electronic switch comprises a transistor switch element and a control transistor, the transistor switch element comprising a switching path arranged between the output of the rectifier circuit lying at high level and the corresponding terminal of the output stage, and which comprises a control input that is held to blocking potential via the conductively maintained switching path of the control transistor driven by the switch control signal, or is held to make potential given an inhibited control transistor. The switch-mode power supply is employable in dc voltage-converted power supplies, particularly given relatively high supply voltages.

Shtulman, et. al. U.S. Pat. No. 5,430,401 describes an electronic switch for switching relatively high voltages, such as telecommunications voltages of the order of 48 volts, in response to logic levels of typically 0 to 5 volts. The switch comprises a MOSFET having a source-drain switching path and a gate; a control transistor controlled from a logic level control terminal; and a potential divider MOSFET source and the control transistor having a tapping point coupled to the MOSFET gate. The potential divider includes a zener dime and/or a resistor connected between the MOSFET source and gate. The switch can be used with a current sensing resistor and a monostable circuit to form an automatically-reset circuit interrupter or electronic fuse.

Lewis, et al. U.S. Pat. No. 5,335,598 describes first and second ganged switches having first and second operative relationships normally operative in the first relationship, and actuated by an external mechanism to the second relationship. In the first relationship, the first switch shunts and short circuits a pyrotechnic device and the second switch shunts and short circuits an energy storage member such as a capacitor. In the second operative relationship of the second switch, a battery charges the capacitor and also introduces a starting signal to an electronic timing circuit to institute a timing sequencer by the circuit for a pre-selected period that is selected via a series of inputs to the electronic timer. When the pre-selected time period has been timed out, the timing circuit introduces a signal to a solid state electronic switch, which is normally in a non-conductive state to prevent actuation. The signal from the timing circuit causes the electronic switch to provide a low impedance. In the second operative relationship of the first and second switches, the capacitor discharges through a circuit which includes the second switch, the electronic switch, the capacitor and the pyrotechnic device. This discharge fires the pyrotechnic device.

De Roo et. al. U.S. Pat. No. 4,520,278 describes an electronic switch for switching electrical signals, comprising an input buffer of the open collector type of which the input is connected to the control input of the switch. The output of said input buffer is connected to the input of an output buffer which the output is connected to the signal output of the switch, a diode of which the other electrode is connected to the signal input of the switch and a load resistance. Furthermore the other terminal of said load resistance is connected to the signal input of the switch.

Lamarche, et. al. U.S. Pat. No. 5,229,653 describes an electronic detection circuit such as a proximity switch or flow detector using a presence detector with complementary outputs, and one or more electronic switches to provide either normally-open or normally-closed operation based on the polarity of the supply connections to the device. In one embodiment, two electronic switches are provided, each operating in response to one of the complementary outputs, with each switch connected to provide current flow in a mutually opposite direction between the supply connections upon activation. In another embodiment, a single electronic switch is provided, and is connected through a diode matrix to the complementary outputs.

The prior art teaches various electronic circuits, several with switching apparatuses. Most of the references describe mere switching devices but do not show how subsequently lighting means would be energized and de-energized in turn. Several references use more complex circuitry to produce light impulses than does the present invention. For instance, one reference employs a rectifier circuit, unnecessary in the present invention. In one reference, the switches activate pyrotechnic devices in a sequential manner, but by means of shunt and short-circuiting and timing sequencers rather than the simple relay devices used in the present invention. The present invention provides further related advantages as described in the following summary.

SUMMARY OF THE INVENTION

The present invention teaches certain benefits in construction and use that give rise to the objectives described below.

The present invention provides an electrical circuit apparatus for producing a light show, utilizing simple mechanical relays. The apparatus includes electrical circuit elements that include electrical relaying means, lighting means, electrical timing means, DC power supplying means, and means for receiving an AC utility current. The present invention streamlines the process of conveying electrical impulses through AC and DC currents into light impulses and enables the light show designer to produce an automatically cycling light show using three different lighting means.

A primary objective of the present invention is to provide an apparatus as described and shown herein having advantages not taught by the prior art.

Another objective is to provide such an apparatus capable of providing greater creative choice to the light show designer by enabling an automatically repeating cycle of light impulses.

A further objective is to provide such an apparatus capable of providing greater creative choice to the light show designer by enabling a light show using three different cyclic time period intervals.

A still further objective is to provide such an apparatus capable of enabling a light show to be designed using simple mechanical relays.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
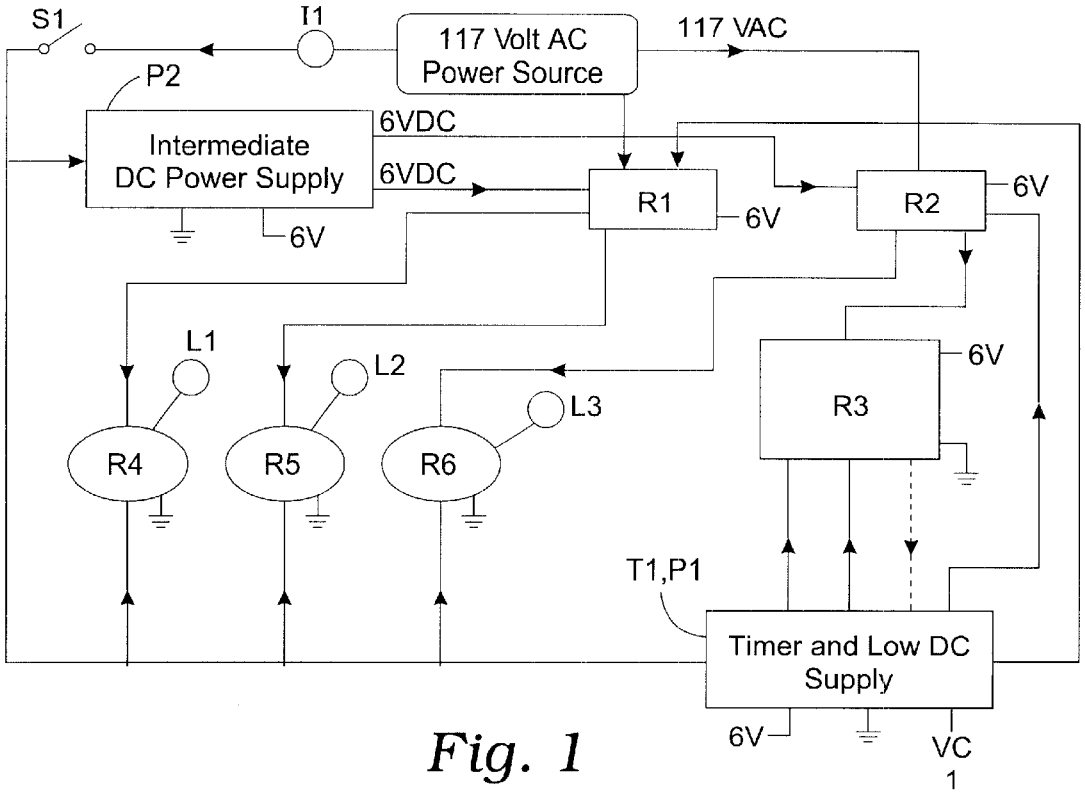
FIG. 1 is an electrical schematic diagram of the preferred embodiment of the present invention.
Figure 2:
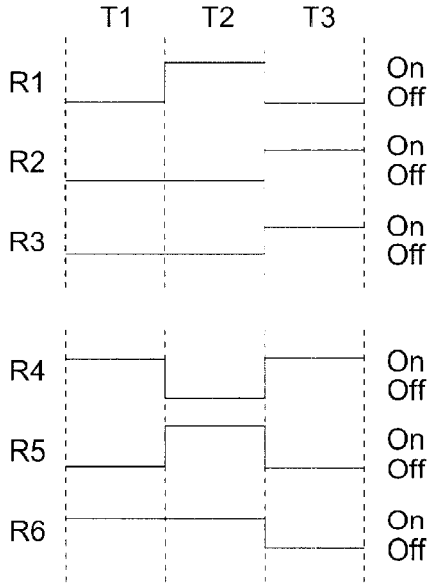
FIG. 2 is a timing diagram showing the three timed cycles utilized in a light show of the present invention.

The above described drawing FIGS. 1–5 illustrate the invention, an electrical circuit apparatus for producing a light show, the apparatus comprising: a plurality of electrical circuit elements including first R!, second R2, third R3, fourth R4, fifth R5 and sixth R6 electrical relaying means, preferably simple mechanical relays of any common type; first L1, second L2 and third L3 lighting means, preferably any lamp device; electrical timing means T1, any timing device having multiple timers, a first P1 (low DC supply) and second P2 intermediate DC power supplying means, and a means for receiving an AC utility current, identified in FIG. 1 as P3, the later being called out as "117 VAC Power Supply" in FIG. 1. The electrical circuit elements defined above are interconnected such that the fourth R4, fifth R5 and sixth R6 electrical relaying means are enabled for driving the first L1, second L2 and third L3 lighting means, respectively and this is preferably accomplished using a transistor for each lighting means. The electrical timing means T1 and the first DC power supplying means provide control power signals to the first R1 and second R2 electrical relaying means. The second R2 electrical relaying means is interconnected for receiving and switching the AC utility current to the third R3 and sixth R6 electrical relaying means. The third R3 electrical relaying means is interconnected for providing a delayed reset of the electrical timing means T1 and the first DC power supplying means P1; such that with the apparatus in an on condition, a light show cycle is conducted when the first lighting means is energized. After a first time period T1 (FIG. 2), the first lighting means L1 is unenergized while the second lighting means L2 is energized. After a second time period T2, the third lighting means L3 is energized, the first lighting means L1 is energized and the second lighting means L2 is unenergized, thereby starting a third time period T3 to conclude and immediately restart the light show cycle, until the apparatus is placed in the off condition. Preferably, the apparatus includes an on-off switch S1 for enabling resetting the apparatus between the on and the off condition. Preferably, the apparatus also includes an indicator lamp I1 for indicating when the apparatus is in the on condition. Preferably, at least one variable control element VC1 is interconnected with the electrical circuit elements, for enabling the variable setting of at least one of the first T1, second T2 and third T3 time periods. A set of transistors are preferably utilized in switching lighting means L1–3 through R4–6 respectively.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A method of operation of an electrical circuit apparatus for producing a light show, the method comprising the steps of:

providing a plurality of electrical circuit elements including electrical relaying means, lighting means, electrical timing means, power supplying means and a means for receiving a utility current;

interconnecting the electrical circuit elements such that the electrical relaying means is enabled for driving the lighting means, the electrical timing means and the power supplying means;

providing control power signals to the electrical relaying means;

receiving and switching the utility current to the electrical relaying means;

providing a delayed reset of the electrical timing means and the power supplying means;

energizing at least one portion of the lighting means for a first time period; deenergizing the at least one portion of the lighting means and simultaneously energizing at least a second portion of the lighting means;

deenergizing the at least second portion of the lighting means and simultaneously energizing the at least first portion and a third portion of the lighting means to complete one cycle of the light show;

repeating the one cycle of the light show continuously until is energized and after a second time period, a third portion of the lighting means is energized, along with the first portion of the lighting means while the second portion of the lighting means is deenergized, thereby starting a third time period to conclude and immediately restart the light show cycle until the utility current is disabled.

* * * * *